US010551041B2

(12) United States Patent
Lozeau et al.

(10) Patent No.: US 10,551,041 B2
(45) Date of Patent: Feb. 4, 2020

(54) LED MODULE, METHODS OF MANUFACTURING SAME AND LUMINAIRE INTEGRATING SAME

(71) Applicant: INDUSTRIES YIFEI WANG INC., Saint-Colomban (CA)

(72) Inventors: Robert Lozeau, Joliette (CA); Andrew Piaskowski, Saint-Colomban (CA)

(73) Assignee: INDUSTRIES YIFEI WANG INC., Saint-Colomban (CA)

( * ) Notice: Subject to any disclaimer, the term of this patent is extended or adjusted under 35 U.S.C. 154(b) by 269 days.

(21) Appl. No.: 15/525,569

(22) PCT Filed: Nov. 16, 2015

(86) PCT No.: PCT/IB2015/058853

§ 371 (c)(1),
(2) Date: May 9, 2017

(87) PCT Pub. No.: WO2016/079658

PCT Pub. Date: May 26, 2016

(65) Prior Publication Data

US 2019/0093863 A1 Mar. 28, 2019

Related U.S. Application Data

(60) Provisional application No. 62/081,188, filed on Nov. 18, 2014, provisional application No. 62/141,215, filed on Mar. 31, 2015.

(51) Int. Cl.

| | |
|---|---|
| ***F21V 19/00*** | (2006.01) |
| ***F21V 31/04*** | (2006.01) |
| ***F21K 9/90*** | (2016.01) |
| ***F21Y 115/10*** | (2016.01) |
| ***F21Y 105/18*** | (2016.01) |

(Continued)

(52) U.S. Cl.

CPC ..... *F21V 19/002* (2013.01); *F21K 9/90* (2013.01); *F21V 31/04* (2013.01);

(Continued)

(58) Field of Classification Search

CPC ..... F21K 9/90; F21V 19/002; F21V 31/04

See application file for complete search history.

(56) References Cited

U.S. PATENT DOCUMENTS 6,045,240 A * 4/2000 Hochstein ..... B60Q 1/2696 362/294

6,686,676 B2 * 2/2004 McNulty ..... B82Y 20/00 313/112

(Continued)

FOREIGN PATENT DOCUMENTS

TW 201328786 7/2013

OTHER PUBLICATIONS

Written Opinion of the International Searching Authority issued by the World Intellectual Property Organization dated Mar. 15, 2016 for PCT application PCT/IB2015/058853 from which the present application claims priority.

(Continued)

*Primary Examiner* — Robert J May
*Assistant Examiner* — Leah Simone Macchiarolo

(57) ABSTRACT

A LED module (14) including a circuit board (20) provided with electrical conductors and defining opposed circuit board first and second surfaces (61 and 62); a power input (40) electrically coupled to the electrical conductors; LEDs (22) provided on the circuit board first surface (61), each LED (22) defining a light emitting surface (23) facing substantially away from the circuit board (20), the LEDs (22) being electrically coupled to the electrical conductors for being powered when the power input is powered; an encapsulation layer (50) having an encapsulation layer index of refraction and covering the circuit board first surface (61) and the LEDs (22); a CCT correcting layer (48) having a CCT correcting layer index of refraction and coating at least part of at least one of the light emitting surfaces (23) and provided between the at least part of the at least one of the (Continued)

light emitting surfaces (23) and the encapsulation layer (50). The CCT correcting layer and encapsulation layer indices of refraction differ from each other.

22 Claims, 10 Drawing Sheets

(51) Int. Cl.
*F21Y 107/20* (2016.01)

(52) U.S. Cl.
CPC ..... *F21Y 2105/18* (2016.08); *F21Y 2107/20* (2016.08); *F21Y 2115/10* (2016.08)

(56) References Cited

U.S. PATENT DOCUMENTS 8,455,607 B2 6/2013 Zhou et al.
8,736,036 B2 5/2014 Chandra
8,841,146 B2 9/2014 Yen et al.
8,906,716 B2 12/2014 Shimokawa et al.
9,133,990 B2 9/2015 Lee et al.
2007/0215998 A1 9/2007 Hu et al.
2009/0001399 A1 1/2009 Diana et al.
2009/0272996 A1 11/2009 Chakraborty
2010/0001297 A1 1/2010 Takashima
2011/0286210 A1 11/2011 Shiue et al.
2013/0146919 A1 6/2013 Grotsch et al.
2018/0209615 A1* 7/2018 Pu ..... F21V 19/002

OTHER PUBLICATIONS

International Search Report issued by the World Intellectual Property Organization dated Mar. 15, 2016 for PCT application PCT/IB2015/058853 from which the present application claims priority.

* cited by examiner

LED MODULE, METHODS OF MANUFACTURING SAME AND LUMINAIRE INTEGRATING SAME

FIELD OF THE INVENTION

The present invention relates to the general field of lighting and is particularly concerned with light emitting diode (LED) modules, methods of manufacturing same and luminaire integrating same.

BACKGROUND

Light Emitting Diode (LED) technology is now internationally accepted as having many advantages for residential, commercial, industrial and institutional illumination due to high efficiency over more standard lighting technologies, such as incandescent light bulbs. In fact, governments around the world have passed measures to phase out incandescent light bulbs for general lighting in favor of more energy-efficient lighting alternatives. Phase-out regulations effectively ban the manufacture, importation or sale of incandescent light bulbs for general lighting, incandescent lamps being presently one of the most inefficient light sources in use.

A LED module is an assembly of an array of individual LEDs or LED chips used to produce higher output illumination than would be possible with a single LED. Moreover, a LED module is often more compact than an array of individual LEDs and is often packaged to enable easy installation onto a heat sink or metal assembly of a lighting fixture or luminaire. There are many types of LED modules in the market place. Some are single color for traffic lights or for signs, warning lights and other similar applications, and others are "white" LEDs specifically intended for illumination purposes to substitute or replace conventional lighting sources such as, but not limited to, fluorescent lamps, fluorescent tubes, incandescent lamps and arc-discharge lamps, among others.

While LED modules are widely used today, they require thermal management to ensure that recommended operating temperatures are not exceeded and also often require to be protected against environmental influences such as water, ice, dust, other air borne particles, and smoke, among others. For thermal management and protection against environmental influences, the user must use suitable protection hardware and covers which add significant cost and require significant engineering skills for guaranteed operational longevity.

One manner of providing such protection would be to encapsulate the LED module. However, such encapsulation has two major issues. First, encapsulation typically changes the correlated color temperature (CCT) of the LED module, which may thus produce light that is not suitable, or at least less suitable, for its intended purpose. Second, encapsulation may reduce heat transfer from the LED module to the environment, which increases the temperature of the LEDs and thus shortens their lifespan.

In addition, LED module manufacturers usually offer very limited performance guarantees due to unknown end user applications, which are known, to misuse/abuse the LED modules by exceeding recommended operating conditions. Moreover, due to unknown operating conditions, the LED module manufacturer cannot offer or guarantee exact performance specifications such as efficacy in Lumen/Watt, chromaticity, lumen maintenance and other performance and fixture parameters, such as, but not limited to end luminaire CCT (Correlated Color Temperature) and CRI (Color Rendering Index).

As with many other light sources such as fluorescent lamps and arc-discharge lamps, LEDs and LED modules require a CC (constant current) or, CP (constant power source), or a characteristic between the two. These "power sources" are called "drivers" and are usually DC (Direct Current) provided by efficient high frequency power supply technology such as SMPS (Switched Mode Power Supplies) or RMPS (Resonant Mode Power Supplies). Most LED drivers are isolated since known LED modules do not comply with International "Double Insulation System" safety standards, so that the safety aspects usually have to be implemented into the drivers.

In addition to the above restrictions, LED modules operate usually at low voltage to enable the user to buy "off the shelf" drivers complying with international safety regulations and outputting voltages within SELV (Safe Extra Low Voltage) levels enabling easy installation and certification to safety standards well-known in the industry. These low voltages are in fact problematic for many high power LED modules making it difficult for strings of parallel and series LED elements or modules to current share correctly for an extended period of time, thus often causing premature failure due to thermal runaway and 'current hogging' reasons Thus, current LED module technology has limitations of isolation, good thermal conduction properties and also a lack in proper hermetic sealing due to technical difficulties of manufacturing a sealed LED module. It is also well known in the art that coating a LED can cause severe spectral and illumination changes and losses due to scattering and diffraction.

Accordingly, there exists a need for improved LED modules. It is a general objective of the present invention to provide such an improved LED module.

SUMMARY OF THE INVENTION

In a broad aspect, the invention provides a light emitting diode (LED) module, the LED module comprising: a circuit board defining opposed circuit board first and second surfaces, the circuit board being provided with electrical conductors; a power input electrically coupled to the electrical conductors; a plurality of light emitting diodes (LEDs) provided on the circuit board first surface, each of the LEDs defining a respective light emitting surface, the light emitting surfaces facing substantially away from the circuit board, the LEDs being electrically coupled to the electrical conductors for being powered when the power input is powered; an encapsulation layer covering the circuit board first surface and the LEDs, the encapsulation layer having an encapsulation layer index of refraction; a correlated color temperature (CCT) correcting layer coating at least part of at least one of the light emitting surfaces and provided between the at least part of the at least one of the light emitting surfaces and the encapsulation layer, the CCT correcting layer having a CCT correcting layer index of refraction. The CCT correcting layer and encapsulation layer indices of refraction differ from each other.

The invention may also provide a LED module wherein the at least one of the light emitting surfaces is entirely coated with the CCT correcting layer.

The invention may also provide a LED module wherein all of the light emitting surfaces are coated with the CCT correcting layer.

The invention may also provide a LED module wherein the CCT correcting layer also covers at least part of the circuit board first surface.

The invention may also provide a LED module wherein the encapsulation layer is waterproof.

The invention may also provide a LED module wherein the encapsulation layer is dustproof.

The invention may also provide a LED module wherein the encapsulation layer is both waterproof and dustproof.

The invention may also provide a LED module wherein the encapsulation layer includes a silicone elastomer.

The invention may also provide a LED module wherein the encapsulation layer consists essentially of a silicone elastomer.

The invention may also provide a LED module wherein the encapsulation layer index of refraction is larger than the CCT correcting layer index of refraction.

The invention may also provide a LED module wherein the CCT correcting layer includes a gas.

The invention may also provide a LED module wherein the CCT correcting layer includes gas bubbles.

The invention may also provide a LED module wherein the gas bubbles include $CO_2$ bubbles.

The invention may also provide a LED module wherein the gas bubbles are dispersed in silicone.

The invention may also provide a LED module wherein at least 80% in volume of the gas bubbles are between 1 and 50 μm in size.

The invention may also provide a LED module wherein the CCT correcting layer includes ethyl ortho silicate.

The invention may also provide a LED module wherein the CCT correcting layer includes titanium butoxide.

The invention may also provide a LED module wherein the encapsulation layer also covers the circuit board second surface and the power input protrudes from the encapsulating layer.

The invention may also provide a LED module wherein the encapsulation layer surrounds substantially entirely the circuit board, LEDs, CCT correcting layer and electrical conductors; and the power input protrudes from the encapsulating layer.

The invention may also provide a LED module wherein the light emitting surface of the at least one of the LEDs is substantially flat.

The invention may also provide a LED module wherein the light emitting surface of the at least one of the LEDs is substantially concave.

The invention may also provide a LED module wherein the light emitting surface of the at least one of the LEDs is substantially convex.

The invention may also provide a LED module wherein the LEDs each include a semiconductor covered by a respective primary LED encapsulation defining the light emitting surface, the primary LED encapsulation including a wavelength converting element for converting at least part of light emitted by the semiconductor to converted light having another wavelength, the encapsulating layer thereby providing a secondary encapsulation of the LEDs.

The invention may also provide a LED module further comprising a module body defining a recess delimited by a module rear wall and a module peripheral wall extending therefrom, the circuit board being mounted in the recess with the circuit board second surface facing the module rear wall in a spaced apart relationship relative thereto.

The invention may also provide a LED module further comprising electrically insulating spacers extending between the circuit board second surface and the module rear wall.

The invention may also provide a LED module wherein the encapsulation layer substantially fills the recess between the circuit board and the module rear wall.

The invention may also provide a LED module wherein the encapsulation layer has a thermal conductivity of about 0.1 W/m K or less.

The invention may also provide a LED module wherein the encapsulation layer can have a thermal conductivity of more than 0.1 W/m K.

The invention may also provide a LED module wherein the module body is made of metal.

The invention may also provide a LED module wherein the encapsulation layer is uncovered so as to be exposed to ambient air when the LED module is in use.

The invention may also provide a LED module wherein the encapsulation layer is vacuum sealed to the circuit board and module body.

The invention may also provide a LED module wherein the circuit board is provided with encapsulation apertures extending therethrough between the circuit board first and second surfaces, the encapsulation layer extending through the encapsulation apertures.

The invention may also provide a LED module wherein the CCT correcting layer is between about 1 μm and about 100 μm thick.

In another broad aspect, the invention provides a luminaire comprising: the LED module as described hereinabove; and a driver circuit electrically connected to the power input for powering the power input with electrical power suitable to power the LEDs when the driver circuit is powered.

The invention may also provide a luminaire further comprising a driver enclosure enclosing the driver circuit, the driver circuit being encapsulated in the driver enclosure by a driver encapsulation material, the driver encapsulation material being electrically insulating.

In yet another broad aspect, the invention provides a method for manufacturing a light emitting diode (LED) module using a circuit board defining opposed circuit board first and second surfaces, the circuit board being provided with LEDs on the circuit board first surface, the LEDs each defining a light emitting surface facing away from the circuit board first surface, the LEDs being electrically connected to a power input, the method comprising the steps of: (a) coating at least part of the circuit board and LEDs with a correlated color temperature (CCT) correcting material such that at least part of at least one of the light emitting surfaces is covered therewith to form a CCT correcting layer; and (b) covering the circuit board first surface, the LEDs and the CCT correcting material with an encapsulating material that differs from the CCT correcting material, the CCT correcting material and encapsulating material having different indices of refraction.

The invention may also provide a method further comprising the steps of (c) emitting intermediate light with the LEDs between steps (a) and (b); (d) measuring an intermediate light CCT of the intermediate light; (e) comparing the intermediate light CCT with a predetermined range of intermediate CCT; and (f) adjusting a thickness of the CCT correcting material if the intermediate light CCT is outside of the predetermined range of intermediate CCT so that the intermediate light CCT is moved towards the predetermined range of intermediate CCT, and leaving intact the thickness of the CCT correcting material if the intermediate light CCT is inside of the predetermined range of intermediate CCT.

The invention may also provide a method further comprising repeating steps (c) to (f) until the intermediate light CCT is inside of the predetermined range of intermediate CCT.

The invention may also provide a method wherein in step (a), the CCT correcting material is dissolved in a solvent, step (a) further including evaporating the solvent before completing step (c).

The invention may also provide a method wherein the CCT correcting material includes ethyl ortho silicate.

The invention may also provide a method wherein the CCT correcting material includes titanium butoxide.

The invention may also provide a method wherein the solvent includes an organic solvent selected from the group consisting of aliphatic hydrocarbon, aliphatic C7 to C12 hydrocarbons, alicyclic C7 to C12 hydrocarbons, and combinations thereof.

The invention may also provide a method wherein step (f) includes one of spraying or pouring the CCT correcting material dissolved in the solvent to increase the thickness of the CCT correcting material and brushing off some of the CCT material to decrease the thickness of the CCT correcting material.

The invention may also provide a method wherein the CCT correcting material includes a gas precursor deposited on the light emitting surfaces, the gas precursor liberating a gas when activated.

The invention may also provide a method wherein the gas precursor is sodium bicarbonate dispersed in a matrix and the matrix includes a silicone, the method further comprising the step (g) of heating the LED module after step (a) to cause the $CO_2$ to be liberated by the sodium bicarbonate.

The invention may also provide a method wherein the sodium bicarbonate is present in the matrix in a concentration resulting in the formation of microscopic bubbles of $CO_2$ at step (g).

The invention may also provide a method wherein the gas precursor is a substance that sublimes when the LED module is heated after step (a) to cause the sublimation substance to emit the gas.

The invention may also provide a method wherein the gas precursor includes at least one of naphthalene, phthalic anhydride and metaformaldehyde.

The invention may also provide a method wherein step (b) also includes covering the circuit board second surface with the encapsulating material, thereby encapsulating the circuit board and the LEDs in the encapsulating material.

The invention may also provide a method wherein the encapsulating material includes a silicone, the method further comprising step (h) of curing the silicone.

The invention may also provide a method wherein step (a) includes covering all of the light emitting surfaces with the CCT correcting material.

The invention may also provide a method wherein step (a) also includes covering at least part of the circuit board first surface with the CCT correcting material.

In yet another broad aspect, the invention provides a LED module as described hereinabove in which the CCT correcting layer is omitted.

In some embodiments, the LED module does not require complex thermal management since the LEDs are distributed over a relatively large surface permitting an even thermal distribution within a layered and encapsulated assembly.

In some embodiments, the LED module and driver may be mechanically fixed directly to a luminaire reflector or metalwork so that the reflector/metalwork acts as an additional heat sink, reducing operational temperatures and increasing reliability and performance.

In some embodiments, the LED module can itself become the luminaire and be implemented as a high power light sources for such application examples as sports lights, stadium lights and high bay lights.

In some embodiments, the LED module requires no protective covers since encapsulation provides protection against the ingress of contaminants, allowing, in some embodiments, total immersion in water.

In some embodiments, the LED module is sufficiently electrically isolated to high voltage levels from the metal mounting plate by the encapsulation layer to provide insulation for Class 1 and Class 2 equipment. As a result of this encapsulation, an isolated driver is not necessary in these embodiments.

In some embodiments, the LED module includes a LED array that is encapsulated by several layers of different encapsulates to tailor to specific CRI shifts, or prevent them completely, and other optical characteristics such as lensing.

In some embodiments, the LED module is protected against misuse by incorporating overload protectors in case of inadvertent direct connection to utility supplies or improper drivers by unqualified persons.

In some embodiments, the LED module and driver assembly is operated at a much de-rated current, enhancing efficacy by taking advantage of a performance algorithm which the LED module permits by innovative design.

In some embodiments, due to complete encapsulation, the performance is enhanced by improving the thermal and derating characteristics which are usually published by the LED manufacturer.

In some embodiments, the LED module can take advantage of low cost LEDs in contrast to high power LED modules which require expensive and highly performing LEDs. Also, in some embodiments, several LED modules can be operated from one driver or several drivers can be used to operate one LED module.

It is further demonstrated that by innovative means and algorithms we have developed, we can enhance the performance of LED modules in efficacy (Lumens per W), CRI (Color Rendering Index) and control the CCT (Correlated Color Index).

Indeed, the white LED is basically a LED chip emitting blue light which interacts with various phosphors which convert the high blue energy photons to other lower energy photons (to lower color temperatures) and thus produce white light from the resulting spectrum. Although it is not the object of this invention to discuss the mechanism and science of LED manufacture, certain important characteristics are described to enable us to demonstrate the behavior of secondary LED coatings and encapsulations according to the invention.

There are many formulations of chips used for white LEDs. The first LEDs were constructed from SiC, later formulations of InGaN (Indium gallium nitride), Zinc and selenide (ZnSe), emerged. Each formulation and application demands different doping levels to create specific characteristics for the user.

It is also well know that COB (Chip On Board) devices can offer some of the highest light output densities possible. However, with high light output density come the challenges of managing high power density, thermal dissipation, rate of degradation of phosphors and management of efficacy.

It is also well known, that in order to produce a COB, low thermal resistances are necessary which involve the use of substrates and heatsinks which often have low isolation voltage properties and as such, most LED modules function from supplies having a voltage or tension of less than 60V.

Due to low voltage operation, to attain high power, current levels are increased, thus the electrical impedance of LED COBs has to be low. A slight change in negative coefficient of impedance of a particular LED string of an array can cause thermal runaway and eventual burn-out. This is a known as a common problem today with LED modules.

The chip formulations of LED chips for COBs and high intensity lighting are thus optimized for ruggedness. High temperature operation compromises efficacy and general performance. To produce a LED with stable light operation over a large high temperature range, a compromise of efficacy (Lm/W) is accepted and often performance of the LED is limited to about 120 Lm/W at an operating temperature of about 80 Deg. C. Thus for cold or hot application, chip doping is optimized for stability over a high temperature range but with reduced efficacy. With LED Chip doping, it is possible to achieve about 200 Lm/W and over, however at high temperature, efficacy drops substantially, for example 120 LM/W at 80 Deg. C.

Another well-known parameter which affects efficacy is current or power density in the LED chip. For high impedance LED chips, commonly used in TV screen back-lighting, dropping the power density increases significantly the efficacy. For example, lumen output is related to current and not to voltage directly. Since a reduction of current in the LED chip also causes the potential to fall across the LED, power dissipation also falls. For a corresponding fall in current, power falls at a rate larger than the falling rate of emitting photons and thus the efficacy lumens per watt increases.

In some embodiments, the present invention uses LEDs of high impedance, high efficacy and low cost at relatively low power densities. In doing so, use of insulation materials, which although have high thermal resistances also offer very high voltage isolation even over relatively small thicknesses, such as for example about 1 mm to 2 mm (over 3500 VAC for example), is allowed. Thus, a high impedance LED array, with many LEDs in series, has low power density, high efficacy and no thermal problems.

In some embodiments, the present invention manages to control CCT when encapsulating the LED module with compounds of refractive index greater than unity.

Furthermore, by having an array which can function at high voltage, with high isolation, a non-isolated driver can be used which is more efficient than an isolated driver for low voltage arrays. A high voltage driver will increase system efficacy by at least 5% to 10% when compared to a low voltage driver.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
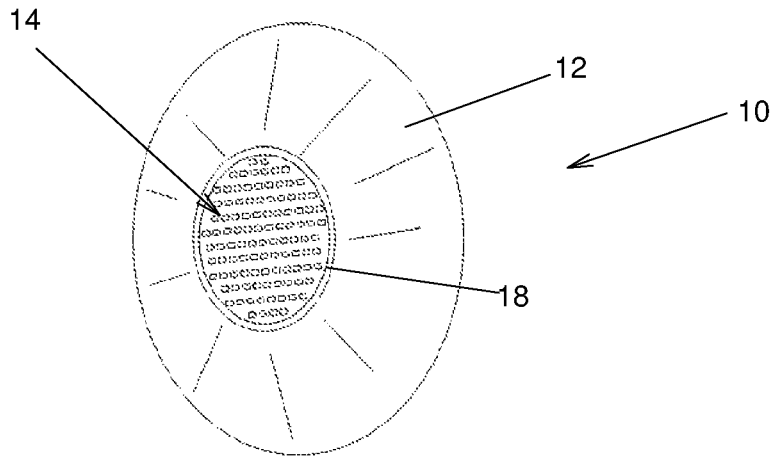
FIG. 1, in a perspective view, illustrates a luminaire in accordance with an embodiment of the present invention.

The present document uses the qualifiers "about" and substantially". These qualifiers are used to denote variations in the thus qualified terms that have no significant effect on the principle of operation of the present invention. These variations may be minor variations in design or variations due to tolerances in manufacturing and use of the present invention. These variations are to be seen with the eye of the reader skilled in the art.

It is understood that when an element such as a layer, region or substrate is referred to as being "on" another element, or covering the other element, it can be directly on the other element or intervening elements may also be present. Furthermore, relative terms such as "inner", "outer", "upper", "above", "lower", "beneath", and "below", and similar terms, may be used herein to describe a relationship of one layer or region to another. It is understood that these terms are intended to encompass different orientations of the device in addition to the orientation shown in the figures.

A person of ordinary skill in the art will understand that a single "layer" of material may actually comprise several individual layers of material. Likewise, several "layers" of material may be considered functionally as a single layer. In other words the term "layer" does not denote a homogenous layer of material. A single "layer" may contain various material concentrations and compositions that are localized in sub-layers. These sub-layers may be formed in a single formation step or in multiple steps. Unless specifically stated otherwise, it is not intended to limit the scope of the invention as embodied in the claims by describing an element as comprising a "layer" or "layers" of material.

Embodiments of the invention are described herein with reference to cross-sectional view illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions or particles illustrated herein but are to include deviations in shapes that result, for example, from manufacturing. A region illustrated or described as rectangular, for example, may have rounded or curved features due to normal manufacturing techniques. Thus, the regions illustrated in the figures are schematic in nature; their shapes are not intended to illustrate the precise shape of a region or particle and are not intended to limit the scope of the invention. The elements are not shown in scale relative to each other but, rather, are shown generally to convey spatial and functional relationships.

The term "light" as used herein is not limited to electromagnetic radiation within the visible spectrum. For convenience, "light" may also include portions of the electromagnetic spectrum outside the visible spectrum, such as the infrared or ultraviolet spectra, for example.

With reference to FIG. 1, there is shown a luminaire 10 in accordance with an embodiment of the present invention. The luminaire 10 is usable with an electrical power source 11 (seen in FIG. 13) providing an input electrical current. The luminaire 10 includes a luminaire body 12, a light emitting diode (LED) module 14 mounted to the luminaire body 12 and a driver 16 (seen in FIG. 2). The driver typically includes a driver circuit and an enclosure enclosing the driver circuit. The driver circuit may encapsulated in the driver enclosure by a driver encapsulation material that is electrically insulating.

While most of the present document discusses the LED module 14 in a context of a luminaire used to lighting applications, the proposed LED module 14 is usable in any other suitable applications. For example, the LED module 14 could be used to provide light used in low level light therapy, among other possibilities. Also, while the driver 16 is shown centered on the LED module 14 in FIG. 2, the driver 16 may be positioned at any other suitable location in alternative embodiments of the invention.

Figure 13:
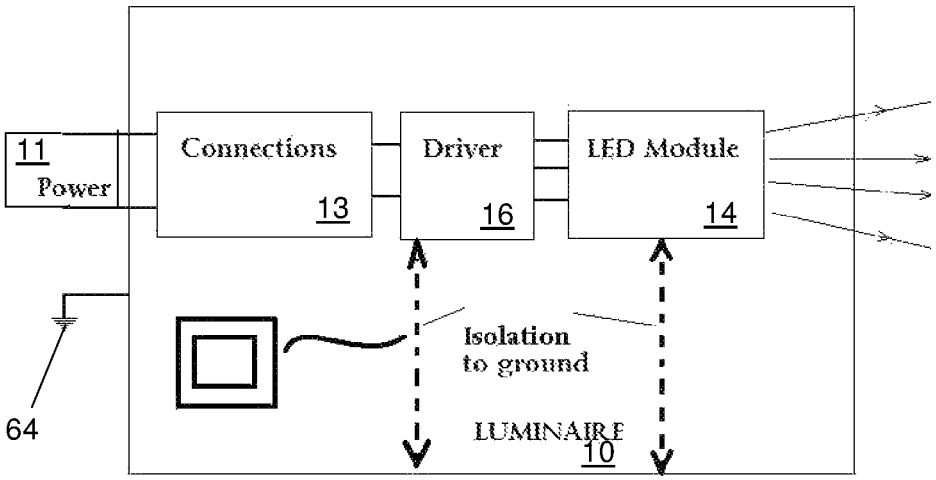
FIG. 13, in a block diagram, illustrates the overall electrical architecture of the luminaire of FIG. 1.

Referring to FIG. 13, there is shown in a block diagram the electrical functions of the luminaire 10. A connector 13 is typically provided between the power source 11 and the driver 16 to allow reversible connection therebetween. The luminaire 10 may also be grounded with a ground 64 when required. In most existing luminaires 10, the driver 16 usually is isolated because the LED module 14 is not capable of sufficient isolation whilst maintaining a good thermal connection to a heat sink or base. In the present invention, in some embodiments, it is not necessary to use an isolating driver, because the whole system may be designed to operate in both Class I and Class II electrical systems. (Class 1 requires a ground connection. If double or reinforced insulation is used as defined by international safety standards the system is defined as Class II). Class II electrical systems are double insulated and a ground connection is not necessary. In Class II systems, leakage current between live parts and ground 64 have to be below a predetermined limits. The driver 16 is electrically connected to the power input of the LED module 14 for powering the power input with electrical power suitable to power the LEDs when the driver 16 is powered.

Figure 4:
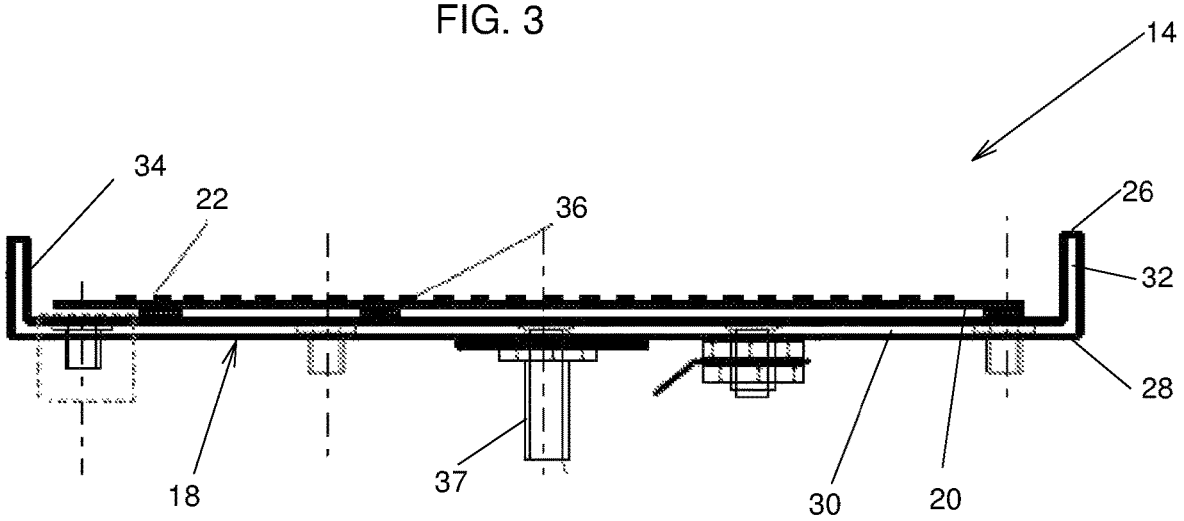
FIG. 4, in a side cross-sectional view with parts removed, illustrates the LED module of FIG. 3.

Referring to FIG. 4, in which some parts of the LED module 14 have been removed, the LED module 14 typically includes a module body 18 (also known as a LED header) and a circuit board 20 mounted to the module body 18. It should be noted that in some embodiments, the module body 18 may be omitted. The circuit board 20 is provided with conventional electrical conductors to interconnect components that may be mounted thereto, typically in the form of printed conductive lines, but which may also take any other suitable forms, such as wires. A power input, described below, is electrically coupled to the electrical conductors to provide power thereto. The circuit board 20 supports at least one LED 22, and typically an array of LEDs 22 including a plurality of LEDs 22 dispersed over a large portion of the surface of the circuit board 20. Typically, the LEDs 22 are spaced apart from each other to manage heat dispersion. The module body 18 defines a module body front end 26, facing the direction towards which light is emitted, and an opposed module body rear end 28. For example, the module body 18 includes a module rear wall 30, which is for example substantially disc-shaped and planar, and a module peripheral wall 32 extending therefrom at the periphery thereof towards the module body front end 26. The module rear wall 30 and module peripheral wall 32 together define a recess 34 in which the circuit board 20 is received. It should be noted that FIG. 4 omits many parts of the LED module 14 for clarity reasons. These parts are better described hereinbelow.

The luminaire 10 includes many electrical connections that are made using electrical wires, and through soldering for components mounted to the circuit board 20. The circuit board 20 is typically a printed circuit board on which electrically conductive lines are printed. The exact details of all these electrical connections are not described hereinbelow as they are conventional.

Figure 3:
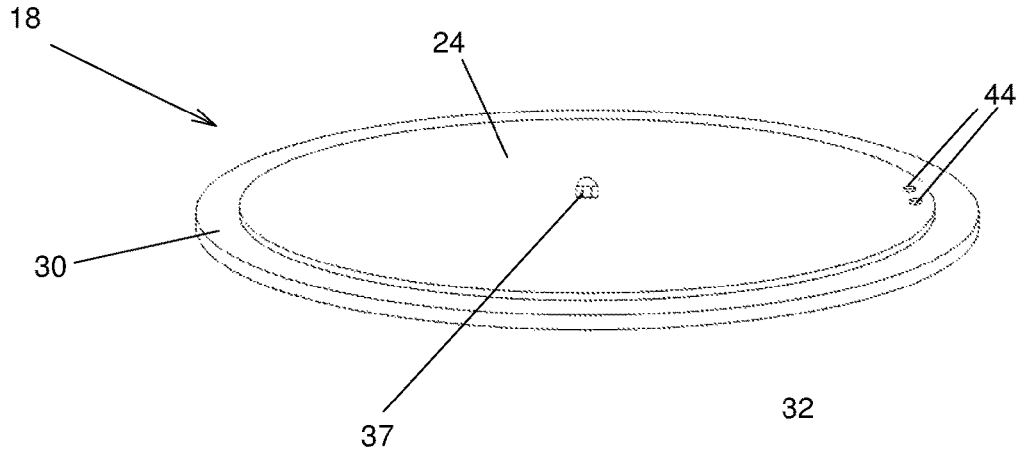
FIG. 3, in a perspective view, illustrates the LED module of FIG. 2 with the driver removed.

FIG. 3 illustrates the back of the module body 18 with the driver 16 removed therefrom. The module body 18 is for example made of metal. In some embodiments, a standard mounting screw 37 extends from the back of the module rear wall 30 for mounting the module body 18 to the luminaire body 12 in a conventional manner. Other manners of mounting the module body 18 to the luminaire body 12 are also within the scope of the invention. Also, a heat spreader 24, basically an additional layer of metal extending across at least part of the module rear wall 30, at the back thereof, may be provided. The heat spreader 24 can also be replaced or supplemented by a heat sink arrangement mounted to the module body 18. This allows, in some embodiments, using the LED module 14 without the luminaire body 12.

The module body 18 performs many functions. First, the module body 18 forms a carrier or base in which the LEDs 22, circuit board 20 and encapsulation (described hereinbelow) is held. Second, the module body 18 acts as a thermal dissipater for the LEDs 22 and enables heat transfer in three modes by convection to the surrounding air by radiation and by conduction to the luminaire body 12. The module body 18 also serves as a means to fix strain reliefs 44 (seen in FIG. 5) for the wires 40 connecting to the circuit board 20. The module body 18 also provides means by which the LED module 14 is fixed to the luminaire body 12.

Figure 2:
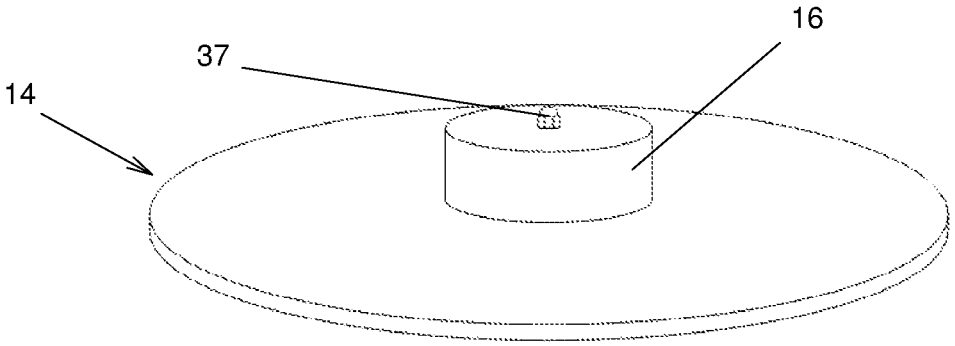
FIG. 2, in a perspective view, illustrates a LED module and driver that may be part of the luminaire of FIG. 1 or be operated separately therefrom.

The driver 16 is electrically connected to the LED module 14 for providing an output electrical current to the at least one LED 22. The driver 16 is operative for receiving the input electrical current from the electrical power source 11 and converting the input electrical current to an output electrical current having different characteristics, the different characteristics being suitable for powering the LEDs 22. In some embodiments of the invention, as seen in FIG. 2, the driver 16 is mounted on the module body 18, on the module rear wall 30, opposite the circuit board 20 (not seen in FIG.

2). The circuit board 20 is typically relatively thin to promote thermal conduction of waste heat generated by the LEDs 22 therethrough.

Figure 9:
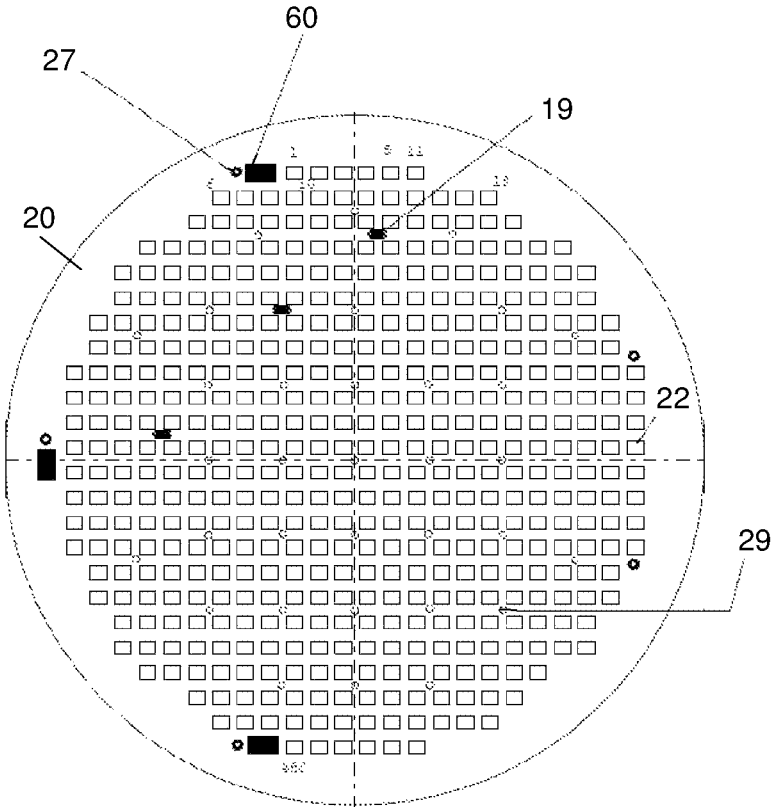
FIG. 9, in top plan view, illustrates a circuit board used in the LED module of FIG. 3.
Figure 10:
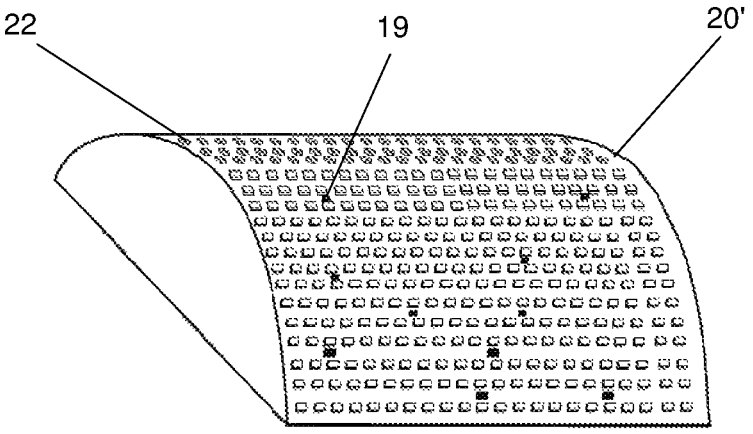
FIG. 10, in a perspective view, illustrates an alternative circuit board used in an alternative LED module.

The LEDs 22 can be disposed in arrays of any size or shape, typically while maintaining a relatively small heat load per unit area, for example several $mW/mm^2$. FIG. 9 illustrates a disc-shaped circuit board 20 with LEDs 22 disposed in a disc-shaped array. FIG. 10 depicts a square circuit board 20' bent into a crescent. By using relatively thin circuit boards 20, many shapes can be achieved without imposing undue stress on the LED components themselves.

Returning to FIG. 9, in some embodiments, Zener diodes 19 (only a few of which are shown in FIG. 9), are inserted as multiple locations along the LED 22 array, between selected adjacent LEDs 22, to protect against reverse polarity and also to enable circuit continuity in case of an open circuit LED 22. For example, one Zener diode 19 is inserted in parallel with every group of several serially connected LEDs 22. In some embodiments, encapsulation apertures 29 may extend at select locations through the circuit board 20 to facilitate encapsulation (described hereinbelow) with an encapsulation material extending therethrough. Pads 27 are provided for electrical connections to the circuit board 20. FIG. 9 omits electrically conducting lines on the circuit board. However, an example of a schematic of how the various components are electrically connected is seen in FIG. 14.

However, on large arrays where upwards of several hundred to thousands of LEDs 22 are used, Zener diodes 19 of FIG. 9 may be omitted, as a single failure of a LED 22 in open circuit will present a very small percentage of the total number LEDs 22 and thus not affect performance.

Figure 14:
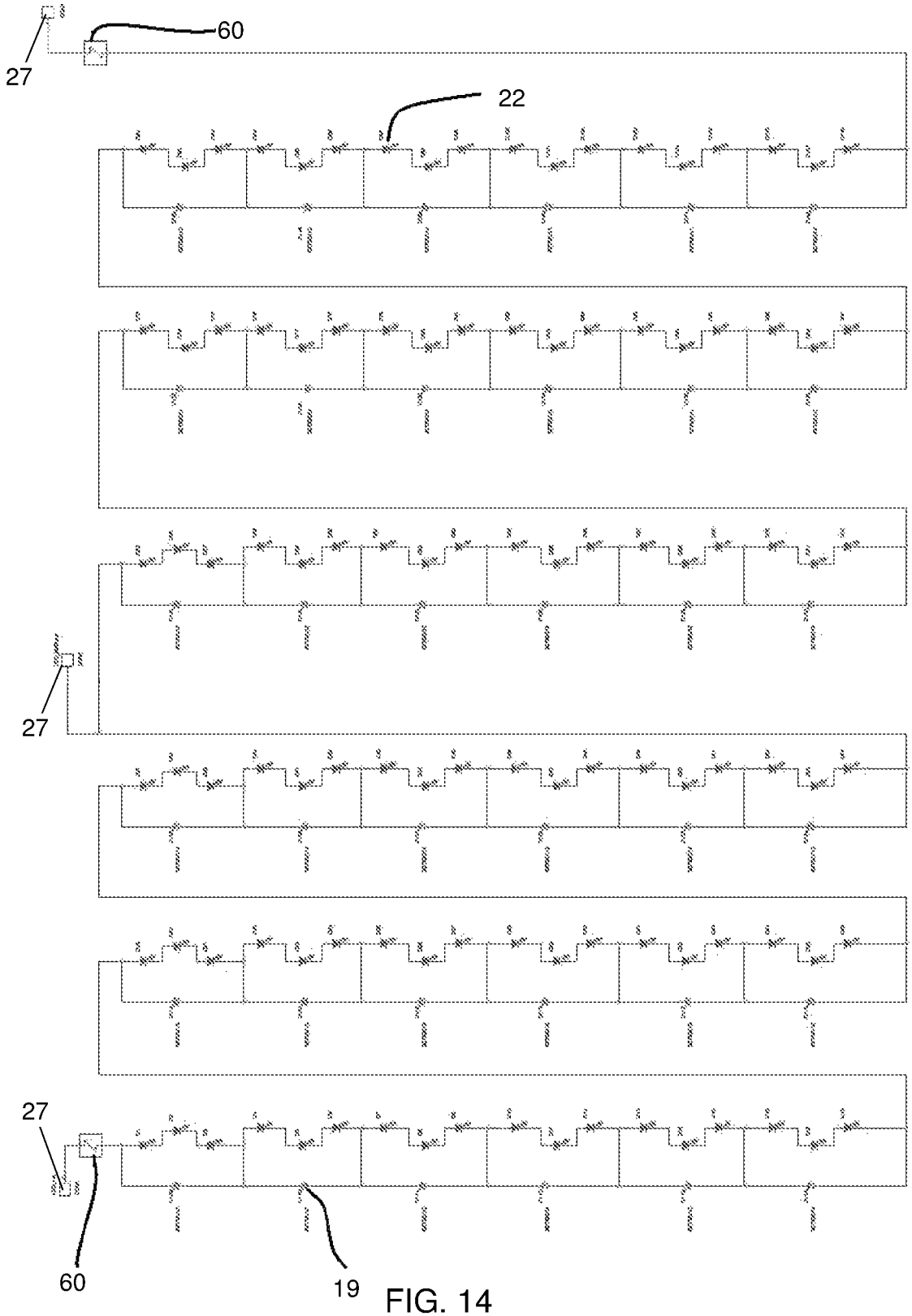
FIG. 14, in an electrical schematic, illustrates an array of LEDs usable in the luminaire of FIG. 1.

FIG. 14 depicts an example of a schematic of an array of LEDs 22 where the LEDs 22 are connected in series. In addition to conventional elements, a protection device 60, for example a surge/over-current protector and/or a thermal device such as a PTC (Positive Temperature Coefficient) thermistor, may be provided between the LEDs 22 and the driver 16 (not shown in FIG. 14). Such protection devices 60 give extra security in case of misuse, for example, direct connection to a utility supply without the use of the driver 16. In the case of high power LED modules 14, the Zener diodes 19 can be eliminated since redundancy can be obtained by many parallel chains of LEDs 22. FIG. 14 also shows the Zener diodes 19.

In some embodiments of the invention, the module body 18 is thermally connected to the luminaire body 12. For example, the module body 18 and the luminaire body 12 abut against each other. In another example, a thermally conductive material is provided therebetween. In some embodiments, to maximize thermal transfer outside of the luminaire 10, both the module body 18 and the luminaire body 12 are made of metal or highly thermally conductive materials.

Figure 5:
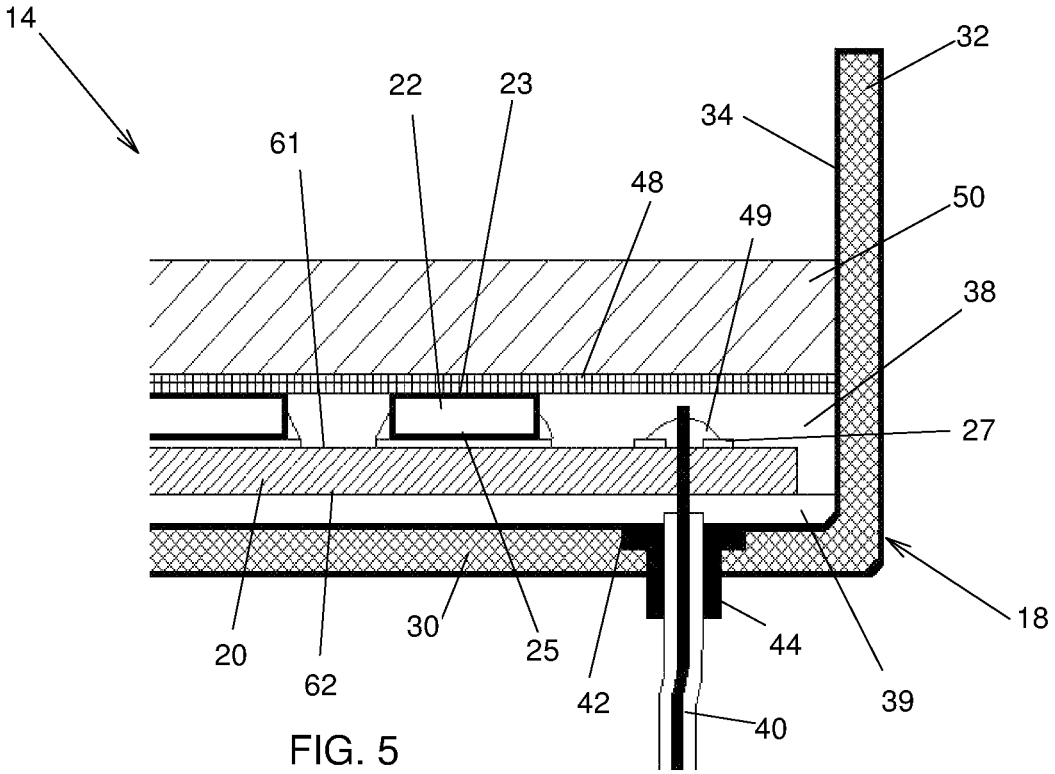
FIG. 5, in a partial side cross-sectional view, illustrates the LED module of FIG. 3.

Referring to FIG. 5, there is shown in greater detail the structure of the LED module 14. As mentioned hereinabove, the circuit board 20 is mounted in the recess 34, in a spaced apart relationship relative to the module rear wall 30. More specifically, the circuit board 20 defines opposed circuit board first and second surfaces 61 and 62. The circuit board second surface 62 faces the module rear wall 30 in a spaced apart relationship relative thereto and the LEDs 22 are provided on the circuit board first surface 61. The LEDs 22 each define a light emitting surface 23, from which light is emitted in operation, and an opposed LED back surface 25. The LEDs 22 are mounted to the circuit board 20, which is typically a printed circuit board or a ceramic header, opposite the module rear wall 30 with the LED back surface 25 facing the circuit board 20 and the light emitting surface 23 facing substantially away from the circuit board 20.

The LEDs 22 are typically of a conventional type and each include a semiconductor covered by a respective primary LED encapsulation defining the light emitting surface 23. The primary LED encapsulation includes a wavelength converting element for converting at least part of the light emitted by the semiconductor to converted light having another wavelength. The proposed invention, with an encapsulating layer 50 described below, provide a secondary encapsulation of the LEDs. The light emitting surface 23 may be substantially flat, substantially concave or substantially convex. The present invention is particularly useful in the first two cases as CCT shift is a known problem when encapsulating these types of LEDs 22.

In some embodiments, spacers 36, seen in FIG. 4, are provided between the circuit board 20 and the module rear wall 30. The spacers 36 are for example silicone pads or any other suitable electrically insulating material. In embodiments in which the circuit board 20 is replaced by a LED supporting structure made of a ceramic or superior material such as insulating carbon fiber board, there is no need for spacers 36. In some embodiments an encapsulation compound in the form of a back encapsulation layer 39 is used to replace spacers 36, as seen in FIG. 5, and made of a suitable material, such as a resin or elastomer. In a specific and non-limiting example, the back encapsulation layer is made of silicone. In some embodiments, the back encapsulation layer 39. In yet other embodiments (not shown in the drawings), both spacers 36 and the back encapsulation layer 39 are provided. The back encapsulation layer 39 and/or circuit board 20 have a sufficient dielectric strength to provide adequate electrical isolation between the module body 18, LEDs 22 and circuit board 20, for example to allow meeting international safety standards for Class I and Class II equipment.

The back encapsulation layer 39 is of adequate thermal conductivity to permit heat transfer from the circuit board 20 to the module body 18. For example, the thermal conductivity K can be high or low. In some embodiments, the back encapsulation layer 39 has a thermal conductivity of about 0.1 W/m K or less. It should be noted that a thermal conductivity K of 0.1 W/m K is typically considered as thermally insulating. However, the proposed luminaire 10 has a relatively large area of thermal transfer and small distance of thermal path so that the heat load of the LEDs 22 generates only a small temperature rise across the back encapsulation layer 39. Example 1 hereinbelow gives a numerical example of such thermal transfer.

In some embodiments, the circuit board first surface 61 is covered with a filler 38. In other embodiments (not shown in the drawings), the filler 38 is not present. The filler 38, if used may encapsulate completely the components on the circuit board 20, leaving only the light emitting surfaces 23 uncovered. The filler 38 is made of a suitable material, such as an elastomer, a resin or a silicone, among others.

Electrical power is typically provided to the circuit board 20 using wires 40 that form a power input and which enters the recess 34 through an aperture 42 provided in the module rear wall 30. A suitable top hat or shoulder washer 44 may be provided to provide mechanical support to the wires 40. The wires 40 protrude from the filler 38.

At least part of one of the light emitting surfaces 23 is coated with a correlated color temperature (CCT) correcting layer 48. In some embodiments, at least one of the light emitting surfaces 23 is entirely coated with the CCT correcting layer 48. In some embodiments, all of the light emitting surfaces 23 are coated with the CCT correcting layer 48. In some embodiments, the CCT correcting layer 48 also covers at least part of the circuit board first surface 61, the filler 38 then not covering the circuit board first surface 61. In other embodiments, when present, the filler 38 could be left free of any coating, coated with a different material or coated with the CCT correcting layer 48. Thus, the term layer is used in the present context to mean a material that covers some parts of the LED module 14, which may include disjoint regions, or be formed of a single joint region. The CCT correcting layer 48 may be solid, liquid, gaseous, a gel, a dispersion of gas in a solid, or any other structure that can achieve the intended purpose of the CCT correcting layer 48. The CCT correcting layer 48 is used to compensate at least in part for CCT changes that would be due to an encapsulation layer 50, described below, if the encapsulation layer 50 were to contact the light emitting surface 23. Thus, the CCT correcting layer 48 is provided between the light emitting surfaces 23 and the encapsulation layer 50. The CCT correcting layer 48 has a CCT correcting layer index of refraction.

The encapsulation layer 50 covers the circuit board first surface 61 and the LEDs 22 and has an encapsulation layer index of refraction. The terminology covers in the present context means that the encapsulation layer 50 extends across the various elements covered thereby, in close proximity thereto, but does not necessarily contact these elements. For example, in some embodiments, the encapsulation layer 50 does not contact any of the light emitting surfaces 23 as the latter are coated with the CCT correcting layer 48. In some embodiments, the encapsulation layer 50 is waterproof, dustproof, or both waterproof and dustproof. Thus, in some embodiments, the encapsulation layer 50 may be uncovered so as to be exposed to ambient air when the LED module is in use, without requiring a front lens or glass cover. In some embodiments, the encapsulation layer 50 is vacuum sealed to the circuit board 20 and module body 18. In some embodiments, the encapsulation layer 50 includes a silicone, or may consist essentially of a silicone. In some embodiments, the second layer 50 is an RTV (Room Temperature Vulcanization) material.

The encapsulation layer 50, filler 38 and back encapsulation layer 39 may together surrounds substantially entirely the circuit board 20, LEDs 22, CCT correcting layer 48 and electrical conductors. Thus the encapsulation layer 50 and filler 38 together form an encapsulation for the electrically powered parts of the LED module 14.

The optical properties of the CCT correcting layer 48 and encapsulation layer 50 are used for tuning optical properties of the LED module 14. To that effect, the CCT correcting layer and encapsulation layer indices of refraction differ from each other. The exact index of refraction and thickness of the CCT correcting layer depend on the LEDs 22 used and type of encapsulation material forming the encapsulation layer 50. Indeed, the CCT correcting layer index of refraction has an effect on the level of refraction, diffraction and scattering of light emitted by the LEDs 22.

Figure 6:
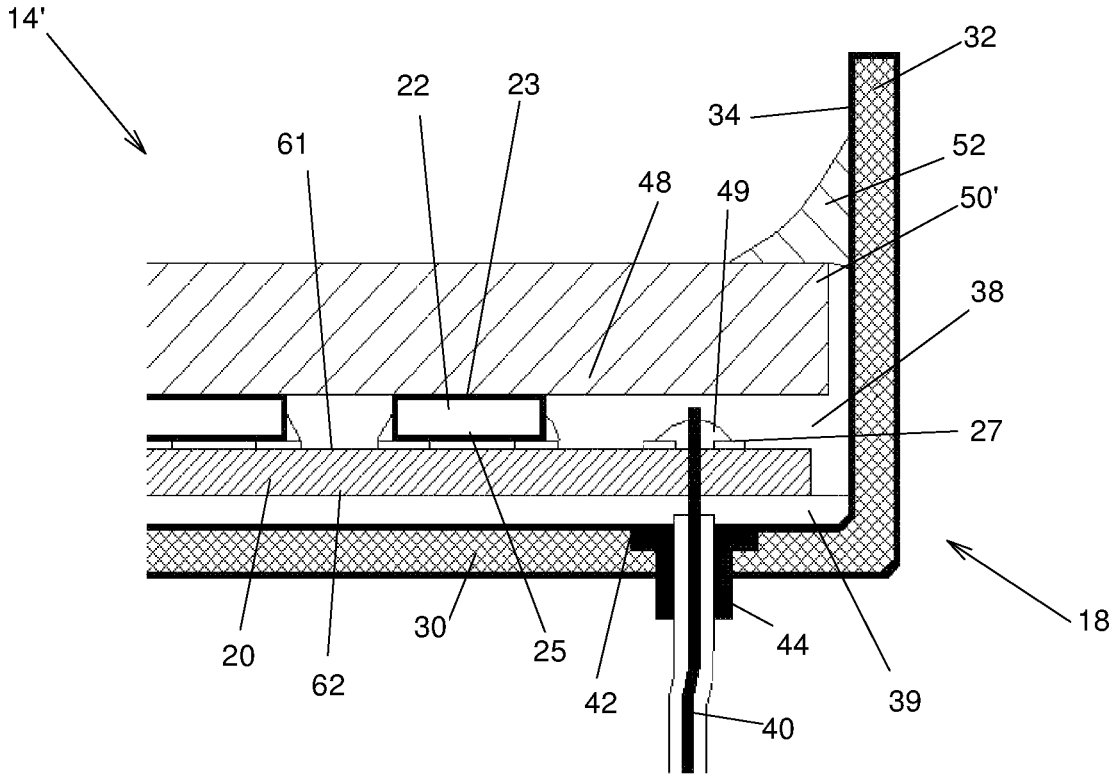
FIG. 6, in a partial side cross-sectional view, illustrates an alternative LED module.

In a first non-limiting example, the CCT correcting layer 48 includes a gas. The CCT correcting layer 48 may be entirely gaseous, or may include gas bubbles dispersed in a matrix. In the first case, as seen in FIG. 6, it may be advantageous to have encapsulating layer 50' be relatively rigid, for example in the form of a solid sheet of polycarbonate or acrylic. In such embodiments, an optional seal 52 may be provided at the junction between the encapsulating layer 50' and the module peripheral wall 32, made of a suitable all-weather RTV sealant. In the second case, an example of such a CCT correcting layer would include $CO_2$ bubbles. Indeed, by manufacturing the LED module 14 with a CCT correcting layer 48 made of sodium bicarbonate as a suspension in an elastomer or RTV, curing at temperatures exceeding 60 deg. C. will release the $CO_2$, which will greatly reduce the effective index of refraction of the CCT correcting layer 48. The gas bubbles may be dispersed for example in silicone. In some embodiments of the invention, at least 80% in volume of the gas bubbles are over 5 μm in diameter, and in some embodiments, form a continuous gas layer over the surface of the individual LEDs In another embodiment of the invention, the CCT correcting layer 48 includes at least one of ethyl ortho silicate and titanium butoxide. These materials have been found particularly advantageous as they may be easily applied when dissolved in a solvent, have suitable optical properties, and are compatible with final encapsulation with silicone elastomers.

To avoid CCT shifts, the thickness of the CCT correction layer 48 is typically in the order of several microns, for example and non-limitingly between about 10 μm and about 100 μm thick. In some embodiments, the index of refraction of the CCT correcting layer may be similar or lower to that of the lens of the LED 22. By varying the thickness of the CCT correcting layer 48 and the CCT correcting layer index of refractions, it is possible to significantly modify both CCT and color rendering index (CRI). CRI may also be improved in some embodiments when the encapsulation layer 50 is thick compared to the CCT correcting layer 48.

It should be noted that in some embodiments, the filler 38 has suitable optical properties so that the CCT correcting layer 48 and filler 38 have the same composition. Also, in some embodiments, the encapsulation layer 50 and back encapsulation layer 39 have the same composition, thus forming an encapsulation of the circuit board 20 and LEDs 22.

Figure 15:
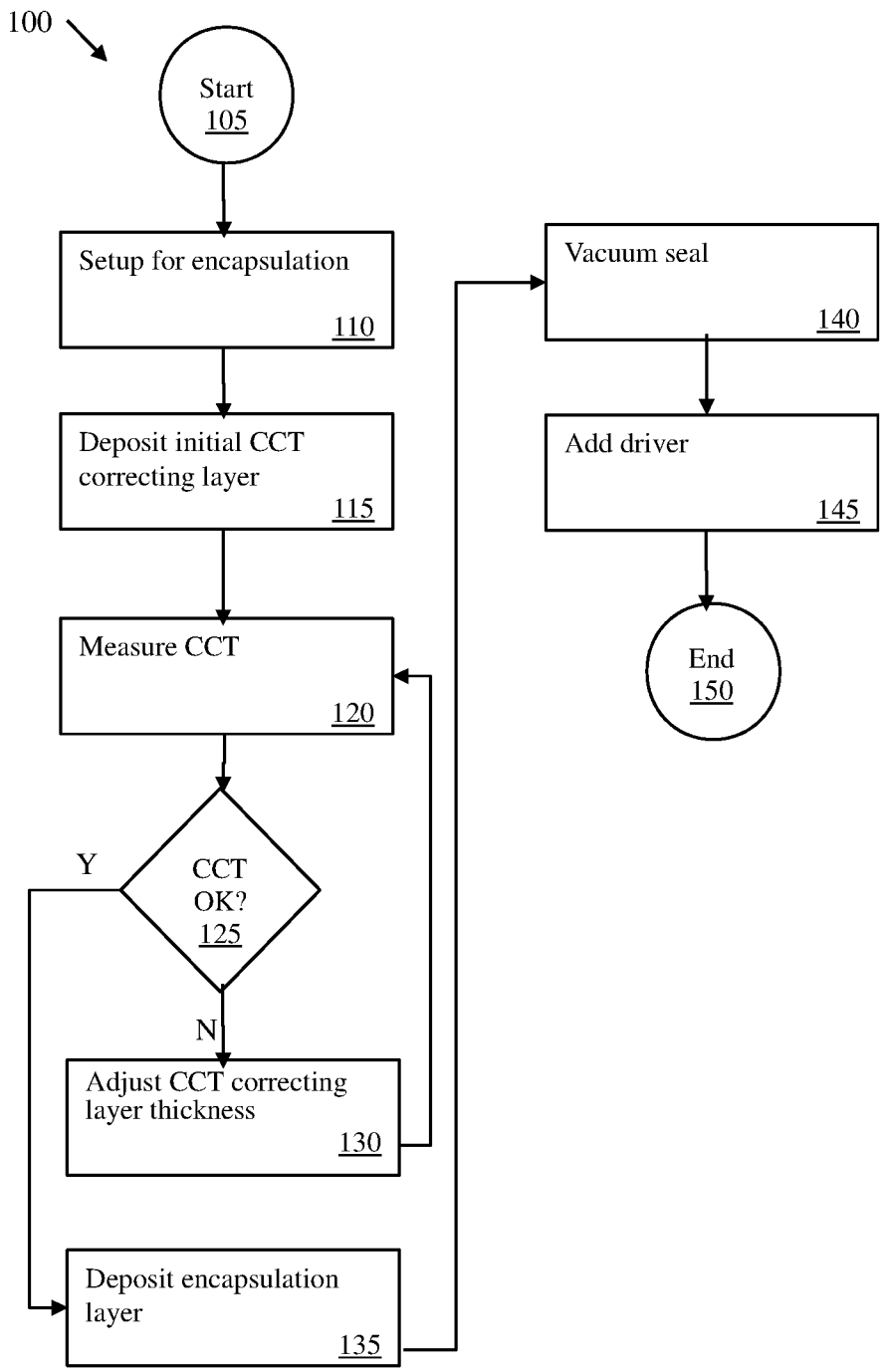
FIG. 15, in a flow chart, illustrates a method for manufacturing the LED module of FIGS. 2 to 5.

The LED module 14 may be manufactured in any suitable manner. One such method 100 of manufacturing the LED module 14, illustrated in FIG. 15, includes applying the CCT correcting layer 48 on the circuit board 20 and LEDs 22 and then applying the encapsulation layer 50. In some embodiments, the CCT is measured between these two applications so that the thickness of the CCT correcting layer 48 may be adjusted to obtain a final CCT of the LED module 14 that is within a predetermined range of module CCT.

A specific and non-limiting example of such a method 100 is as follows. The reader skilled in the art will appreciate that depending on the structure of the LED module 14 and materials used to manufacture the LED module 14, some of the steps described below may be omitted or replaced by other suitable steps. Method 100 supposes that the circuit board 20 and LEDs 22 have been manufactured and assembled conventionally.

The method 100 may be performed manually, or may be automated using equipment of the type commonly used in LED module manufacturing. The present invention may modify such equipment by adding a CCT meter that may be used to measure the CCT of light emitted by the LED module 14 at various steps along its manufacturing. Such measurements may be performed automatically or manually.

The method 100 starts at step 105. Then, at step 110, encapsulation setup is performed. This step prepares the module body 18 to receive the circuit board 20 with LEDs 22 already secured thereto and positions the circuit board 20 in the recess 34. Then, at step 115, an initial CCT correcting layer 48 is deposited, after which, at step 120, CCT is measured. At step 125, it is determined if the CCT measured at step 120, at an intermediate stage of manufacturing, is inside a predetermined range of intermediate CCTs. If not, the thickness of the CCT correcting layer 48 is adjusted at step 130 and the method returns to step 125. If yes, the method jumps to step 135 at which the encapsulation layer 50 is deposited. In some embodiments, at step 140, the encapsulation layer 50 is vacuum sealed. Afterwards, the driver 16 is added to the LED module at step 145, and the method ends at step 150.

Step 110 includes many operations. For example, the module body 18 may be heated, if needed, and a primer may be sprayed thereonto. The primer is a compound that will promote adhesion of the back encapsulation layer 39 and encapsulation layer 50 to the module body 18 and depends on the exact composition of the back encapsulation layer 39 and encapsulation layer 50. Such primers are known in the art. Then, a layer of the back encapsulation layer 39 is deposited, the circuit board 20 is positioned in the module body 18 and any solder connections required to connect the circuit board 20 to the wires 40 are made. If the filler 38 is to cover part of the circuit board first surface 61, the filler material is then also deposited. The back encapsulation layer 39 and filler 38 may for example take the form of a curable material that is poured in a liquid state and left to cure at ambient temperature to rigidify, or heated if required for the same reason. In embodiments in which the filler material does not fill out the space between the LEDs 22, no more filler material is added. The filler 38, if applied in sufficient quantity at suitable locations, may cover the circuit board second surface 62 and join the encapsulation layer 50 at its periphery, with or without CCT correcting material therebetween.

At step 115, an initial CCT correcting layer 48 is deposited to coat at least part of the circuit board 20 and LEDs 22 with the CCT correcting material. Typically, all the LEDs 22 are thus coated. In some embodiments, the CCT correcting material is dissolved in a solvent. A specific example would be ethyl ortho silicate dissolved and/or titanium butoxide dissolved in a solvent including an organic solvent selected from the group consisting of aliphatic hydrocarbon, aliphatic C7 to C12 hydrocarbons, alicyclic C7 to C12 hydrocarbons, and combinations thereof. In such cases, step 115 includes spraying or pouring the dissolved CCT correcting material and then evaporating the solvent, either at room temperature or in an oven. The thickness of the CCT correcting layer 48 must be adequately selected so that the finished LED module 14 has a desired CCT. For example, when the CCT correcting material is ethyl ortho silicate and/or titanium butoxide and the encapsulation material is a silicone, it was found that the following experimentally derived formula applies $$CCTf=CCT+(Th\ CCTi/\alpha)\exp[(CCTi-CCTp)/(CCTi+CCTp)]^{\wedge}-1$$

wherein

CCTf is the final or target CCT of the encapsulated LED module 14 in degrees Kelvin CCTi is the initial CCT of the LEDs 22 in degrees Kelvin CCTp is the CCT in degrees Kelvin of the LEDs 22 after the CCT correcting material has been applied Th is the Thickness of the silicone encapsulation in mm above the light emitting surface 23

$\alpha$ is the CCT millimetric shift constant that is experimentally determined.

Thus, when the right thickness of CCT correcting material is deposited to achieve CCTp, CCTf can be determined. Usually, the reverse is desired so that we want to know what is CCTp to achieve to obtain a predetermined CCTf, which can be numerically solved for.

Through experimentation, one can determine how thick the CCT correcting layer 48 should be to obtain a desired CCTp, which allows applying the CCT correcting material suitably. For example, if the CCT correcting material is dissolved in a solvent, a volume of such a solution can be calculated from its concentration and the surface area of the circuit board 20 so that a suitable quantity of solution is sprayed uniformly or poured to achieve this desired CCTp.

In other embodiments, the CCT correcting material includes a gas precursor dissolved in a matrix, the gas precursor liberating a gas in the matrix when activated. Activation may includes heating the gas precursor and matrix. In other examples, the gas precursor is in the form of a layer that is covered by the encapsulation material before being activated. In yet other examples, the gas precursor includes a substance that sublimes when the LED module is heated after step (a) or left at room temperature to cause the substance to emit its gas. Examples of such substances includes at least one of naphthalene, phthalic anhydride and metaformaldehyde. In other examples, activation includes adding a catalyst to the matrix or lowering or increasing a pressure around the matrix, among other possibilities. In a specific example, the gas precursor is sodium bicarbonate and the matrix includes a silicone. Step 115 then also includes heating the LED module 14 with the applied CCT correcting material to cause $CO_2$ to be liberated by the sodium bicarbonate. Typically, sodium bicarbonate is present in the matrix in a concentration resulting in the formation of microscopic bubbles of $CO_2$ at step (g). Such bubbles may have dimensions such as those stated hereinabove.

While methods for determining the quantity of CCT correcting material to use at step 115 are given herein, the present method may be improved, in some embodiments, by not relying only on theoretical computations, but to use this theory as a first approximation. Indeed, for many reasons, the actual CCT of the LED module 14 after step 115 may not be exactly as calculated. In this case, an iterative method of achieving such a CCT begins at step 120 by emitting intermediate light with the LEDs 22 after step 115 and measuring an intermediate light CCT of the intermediate light with at CCT meter.

At step 125, the intermediate light CCT is compared with a predetermined range of intermediate CCT. A range is typically used as obtaining an exact value of CCT is not required for many applications, and would be relatively difficult anyways to achieve. The predetermined range of intermediate CCT may be bounded at one end or at two ends. In other words, we may want to achieve a CCT that is at least or at most a predetermined CCT or between two predetermined CCT values. In the latter case, a range varying by about 100K may be acceptable.

Step 130 is performed if the intermediate light CCT is not suitable. In that case, step 130 includes adjusting a thickness of the CCT correcting material so that the intermediate light CCT is moved towards the predetermined range of intermediate CCT. Steps 125 and 130 are repeated in a loop until the intermediate light CCT is inside of the predetermined range of intermediate CCT.

Step 130 includes adding or removing CCT correcting material to respectively decrease or increase the intermediate light CCT. For example, adding CCT correcting material includes spraying or pouring the CCT correcting material dissolved in the solvent to increase the thickness of the CCT correcting material. For example, when the CCT correcting material is in powder form, for example after evaporation of a solvent, removing CCT correcting material includes brushing off some of the CCT material to decrease the thickness of the CCT correcting material.

Once a suitable intermediate light CCT has been achieved, or if no CCT adjustment is desired after step 115, the thickness of the CCT correcting material is left intact and the encapsulation layer 50 is deposited at step 135. For example, the circuit board first surface 61, the LEDs 22 and the CCT correcting material are covered with the encapsulating material. For example, in the case of silicone, the silicone is poured to achieve a suitable thickness. This thickness may be predetermined, or CCT of the LED module 14 may be measured as the CCT correcting material is added until a desired CCT is achieved. If required, as is the case for silicone, the encapsulation layer 50 may be cured.

In some embodiments, at step 140, the LED module 14 is enclosed in a vacuum chamber to vacuum seal the LED module 14. Afterwards, the driver 145, which may also be encapsulated in an electrically insulating material, is secured to the module body 18.

The proposed LED module 14 has improved CCT properties as any substance with differing index of refraction deposited on top of the light emitting surface 23 has the effect of changing CCT shift, which is particularly advantageous on flat or concave lensed LEDs 22. LEDs 22 with convex shaped lenses usually have a fall in CCT when encapsulating with elastomers, which may be less problematic for many applications.

The thickness of the encapsulation layer 50 is chosen to provide adequate protection against ingress of contaminants and also for isolation in HV (High Voltage) applications, which may affect the CCT by its thickness. The difference between the CCT correcting layer and encapsulation layer indices of refraction is selected to control level of scattering between layers. Hence, in some embodiments of our invention, this allows control the CCT shift. Finally, by selecting the transmission spectrum of the CCT correcting layer 48 and encapsulation layer 50, different spectral characteristics of the light emitted by the luminaire 10 can be achieved.

Example 1: Thermal Conductivity

Taking for example, a LED module 14 performing at over 105 Lm/W, the inferred useful illumination is 105 Lm radiated for every 1 W consumed. However, laws of physics dictate that 100% luminous efficacy is 683 Lm/W, i.e. if we had a system at luminous efficacy of 683 Lm/W than every watt of power entering the LEDs 22 would be radiated out as photon energy and there would be no thermal energy to dissipate and as consequence there would be no temperature rise of the LEDs 22.

However, in reality, we do not have 100% efficient LEDs 22 at our disposal, 105 Lm/W is still a significant proportion of 683 Lm/W thus we can say that a system producing 105 Lm/W only needs to dissipate: (1−105/683)=0.846 W for each 105 Lm radiated in photons. For example, a LED Module 14 producing 5000 Lm unit will require 47.62 W of power in which 40.28 W requires to be dissipated. Since we have three transport mechanisms for power dissipation, 7.34 W is radiated directly out as light, and remaining 40.28 W is dissipated by several means: convection by means of the outer surface of the LED module 14 (which is large compared to conventional modules) and by conduction through the module body 18 to the luminaire body 12 which then cools by convection to ambient air directly or through other parts of the luminaire 10. Thermal calculations show that for a 30° C. rise of an LED Module 14 of area of 20,000 $mm^2$ (typical for a 5000 Lm LED module 14), dissipation by convection at normal temperature and pressure would be in the order of 10 W. Thus, for a module receiving 47.62 W of power, the heat load for the filler 38, CCT correcting layer 48, back encapsulation layer 39 and encapsulation layer 50 would be only 40.28 W−10 W=30.28 W.

Thus for a total area of 20,000 $mm^2$ the heat load would be 30.28/20,000=1.5 $mW/mm^2$ of area. The temperature rise across the back encapsulation layer 39, CCT correcting layer 48 and encapsulation layer 50, at 0.1 W/m-K would therefore be: 0.0015*0.001/(1E−6)=1.5° C. Thus, in the proposed LED module 14 in the present example, the LEDs 22 operate at almost the same temperature as the module body 18. An impact of the proposed novel design is that it is possible to use a large quantity of low cost LEDs 22 with low temperature ratings and obtain superior thermal operating characteristics than existing COB LED modules. A COB module does not have substantial surface area, and as such most of the heat generated has to pass through the substrate of the module.

Example 2: Operating Temperatures

Figure 7:
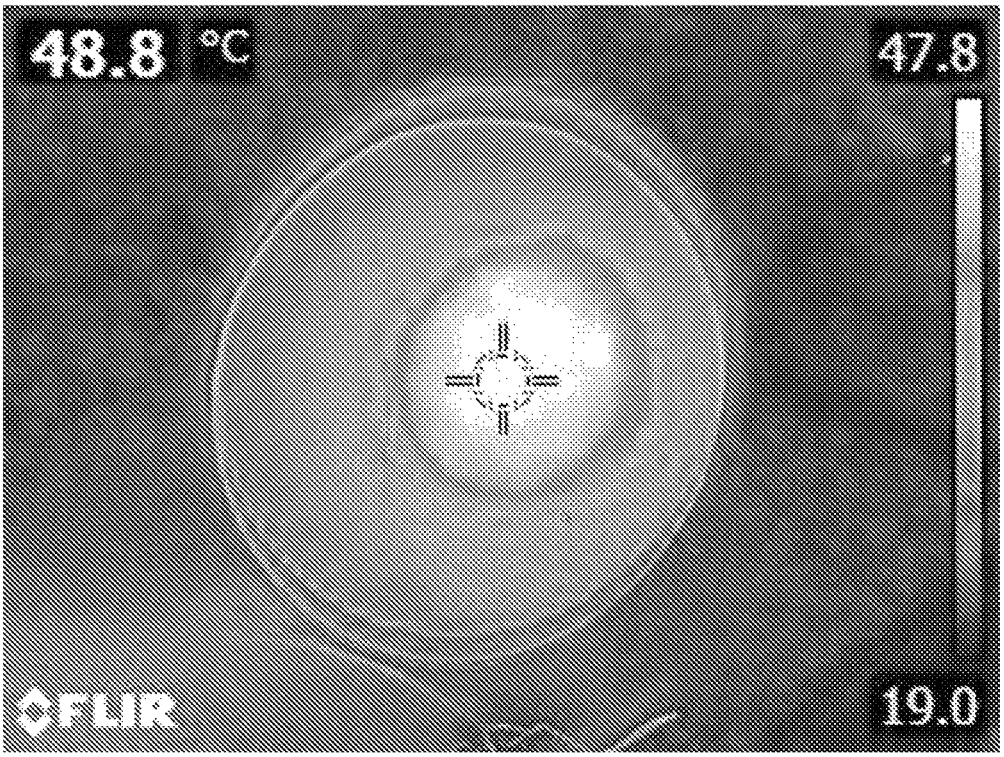
FIG. 7, in a thermal photograph from a first viewpoint, illustrates the luminaire of FIG. 1 in operation.

FIG. 7 shows the temperature of the LED module 14 as described in example 1 and mounted to a luminaire body 12 as being 48.8° C. The actual temperature of the LEDs 22 is almost the same due to the encapsulation system. The temperature rise of 25.8° C. above ambient temperature depicts a superior LED module 14 over competitive products which use LED COBs (Chips-on-Board) that typically run at 70° C. with similar mounting techniques and same power levels. At 70° C. projected lifetimes of a product are about 4 times less than at 50° C. (according to Arrhenius Law). Furthermore, LED COBs require extra protection against the natural environment and considerable extra thermal management.

Figure 8:
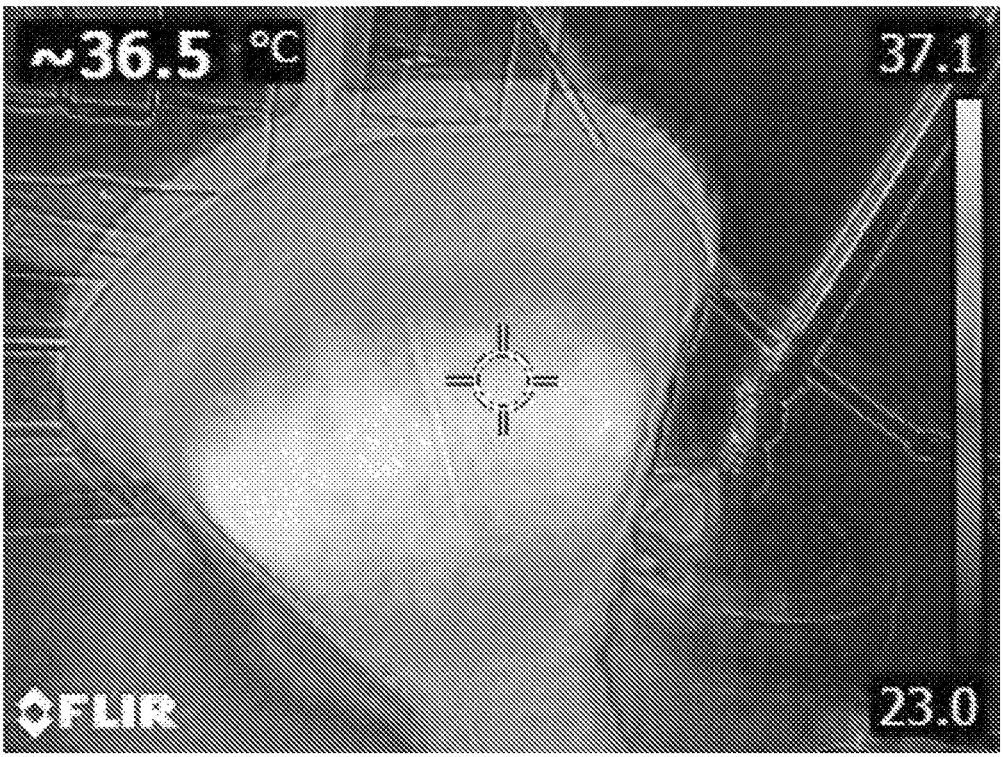
FIG. 8, in a thermal photograph from a second view point, illustrates the luminaire of FIG. 1 in operation.

FIG. 8 shows an IR image of the external part of the luminaire reflector, or luminaire body 12, containing the LED module 14 of example 1. As can be seen, since the LED module 14 is directly fitted to the reflector, the maximum hot-spot temperature difference between the hottest part of the LED Module 14 and the external point of contact to the luminaire body 12 is only 12° C. The proposed LED Module 14 permits direct contact to the luminaire metalwork or reflector to give superior thermal performance.

Example 3: Spectral Characteristics of Emitted Light

Figure 11:
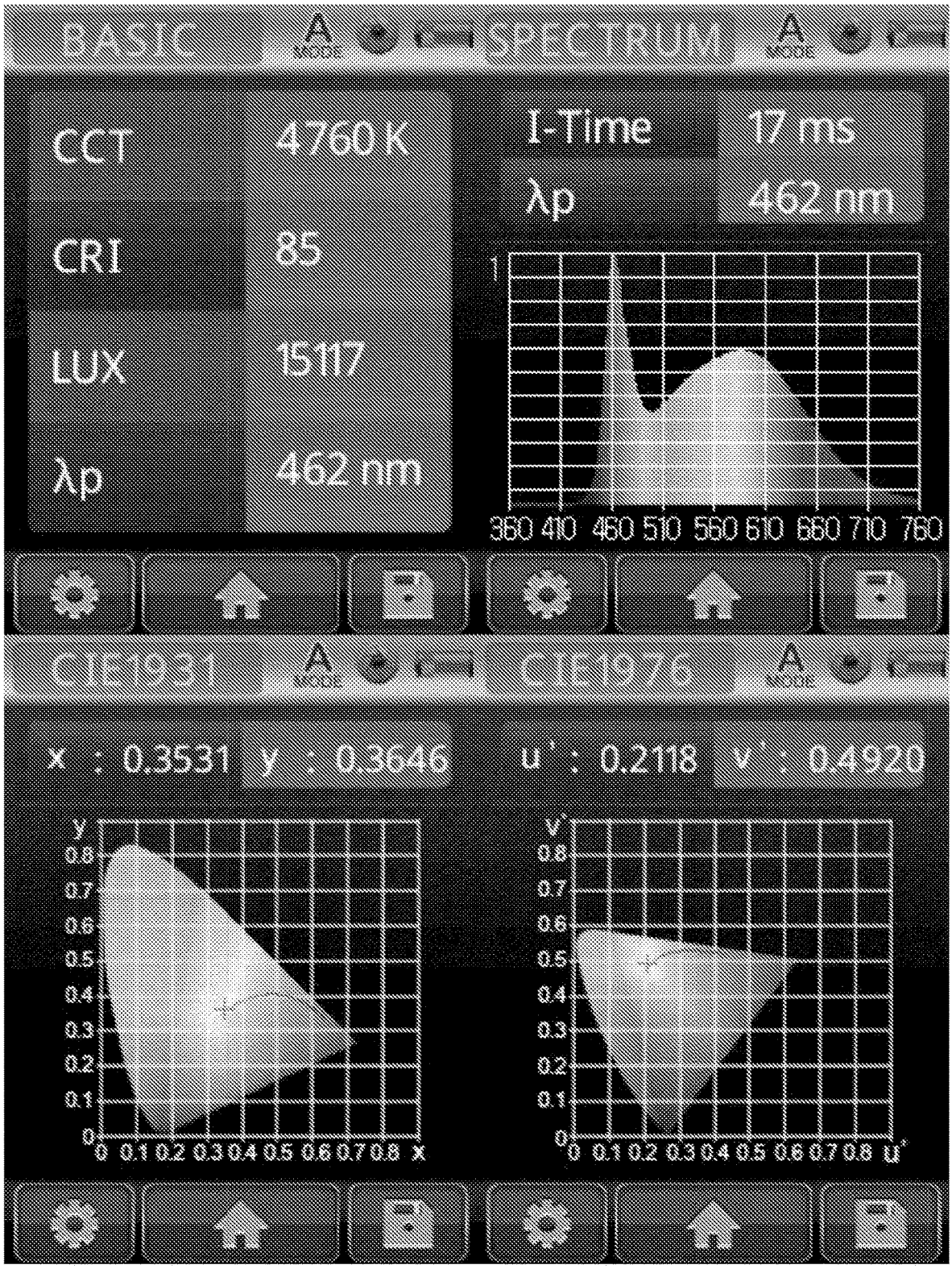
FIG. 11, in X-Y graphics, illustrates the spectral characteristics of a first embodiment of a luminaire in accordance with the present invention.
Figure 12:
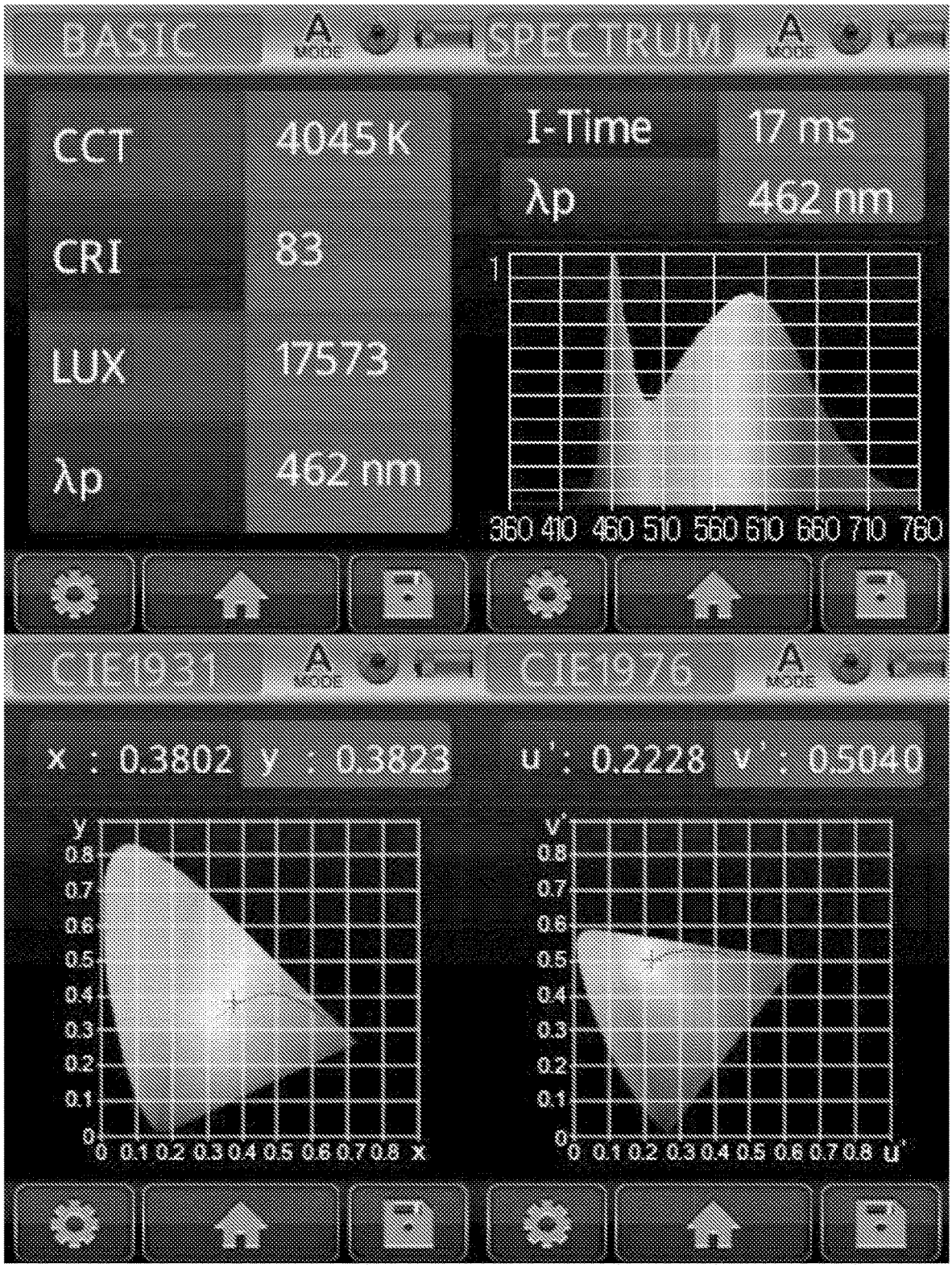
FIG. 12, in X-Y graphics, illustrates the spectral characteristics of a second embodiment of a luminaire in accordance with the present invention with CCT reduced.

LED modules 14 having different CCT correcting layers 48 and encapsulation layers 50 have been manufactured. A clear CCT correcting layer 48 and encapsulation layer 50 achieved a low CCT of the order of 4045K with a base LED CCT in the order of 3700K. Spectrophotometer measurements for this LED module 14 are shown in FIG. 11 in which ethyl ortho silicate and titanium butoxide were used to form the CCT correcting layer with 2 mm of silicone elastomer forming the encapsulation layer 50. Another CCT correcting layers 48 and encapsulation layers 50 achieved a CCT of 4760K. The same result was achieved using a rigid acrylic encapsulating layer 50' instead of the silicone elastomer. Spectrophotometer measurements for this LED module 14 are shown in FIG. 12.

Example 4: Performance Prediction

The composition of back encapsulation layer 39 is of little or no optical importance being on the reverse side of the LEDs 22 array; however, its thermal properties are of some consideration since the heat load generated by the LEDs 22 is mainly transferred through this interface. However, in some embodiments, back encapsulation layer 39 needs to have only moderate thermal conductivity in the order of 0.1 W/m-K or less. In most cases back encapsulation layer 39 can be of the same material as filler 38 to avoid an additional encapsulation processes.

In considering the optical properties of the LED module 14, for the most part, the basic CCT of the LED module 14 is determined by the LEDs 22. LEDs 22 can be purchased at a large selection of color temperature range or CCT, for example, more commonly from 2200K to 10,000K. Warm white light is considered as CCT 3000K and harsh white light in the CCT range of 6000K 7000K.

LEDs 22 are also selected for CRI (Color Rendering Index). A CRI of 100 is considered a spectrum emulating the solar spectrum on earth on a clear bright day. Although LED CRIs can approach very high values at over 95, it is difficult nor cost effective to source these devices for large arrays, however a minimum level of 80 CRI is acceptable in the international lighting community as a good light source. Higher CRI improves correct color reproduction. For example a "red" LED can never have a high CRI because other colors cannot be reproduced by its light. Solar radiation on a bright day has a typical CCT of 5500K with CRI of 100. All colors are reproduced correctly in sunlight and our eyes have evolved to do this in the solar spectrum.

Artificial lighting however cannot match perfectly the solar spectrum so there is always some distortion in correct color rendering by artificial sources. In some embodiments, the present invention also improves the optical performance of LED lighting by various optical encapsulations. In some embodiments, due to the superior thermal design of the proposed LED modules 14, the present invention enhances the general performance of LED modules 14 over competitive ones using the same LEDs 22.

LEDs 22 and LED modules 14 are usually specified with CCTs and CRIs as in other lighting products. A lighting engineer typically first chooses these two basic parameters depending on the application. For example luminaires 10 with a "green bias" would be with predominant wavelengths of between 500 nM~560 nM with a CCT of 4500K, these luminaires 10 may have a low CRI but would enhance the freshness look of green vegetables in a supermarket.

LED CCT and CRI availability differs according to market demand and popularity, for example a CCT of 3500K is less available for general lighting than a 3000K or 4000K product. LEDs of CRI>80 are easier to obtain when the CCT is >3000K. This is common sense, since, the larger the transgression from the solar spectrum, the less likely it would be to find good CRI indexes of >80.

A problem experienced in the LED industry is that when an LED is encapsulated, the CCT will often shift to a higher value. The percentage of CCT shift is more pronounced on higher CCT emitting LEDs than on lower CCT LEDs. This phenomena has not been properly understood, explained, solved, or discussed in open forums and in most cases a closely guarded secret in the industry.

We have found that the CCT shift phenomena are due to several optical interactions between the LED 22 and the surrounding encapsulation. Firstly the shape of the LED surface or dome structure, creating the light emitting surface 23, has a considerable influence. LEDs 22 have varying structures depending on the manufacturer, and as such, encapsulation of LEDs 22 by varying optical compounds can have profound optical effects due to refraction, diffraction and scattering to the surrounding encapsulates.

Most LED module manufacturers have mitigated the problem by sealing the LED 22 module by optical glasses or plastics and maintain a void between the LED surface phosphor and the hermetic seal. This has obvious disadvantages of inferior thermal performance. In another instance of LED modules 14, the manufacturer will acquire LEDs 22 that are molded with individual plastic encapsulates on each LED 22 to avoid the problem; however the LED chip area in relation to the dissipating surface is small rendering inferior performance to the process of encapsulating large LED populated surfaces. In some embodiments of the present invention, there is no void or gas layer between the light emitting surface 23 and the surface of the LED module 14 that is the example the surface of the encapsulation layer 50.

The CCT correcting material must also be compatible with the LED manufacturer's recommendations. Encapsulations can cause stresses if the CTE (Coefficient of Linear Expansion) are dissimilar. Another option to prevent upward CCT shift is to have the LEDs 22 covered with a domed coatings over each LED 22 of equal RIs and densities of silicone elastomer compounds than the surrounding encapsulations or LED phosphor encapsulation. The present invention manages to control CCT with concave LEDs normally used in backlight illumination is LCD screens.

Although the present invention has been described hereinabove by way of preferred embodiments thereof, it can be modified, without departing from the spirit and nature of the subject invention as defined in the appended claims.

What is claimed is:

1. A light emitting diode (LED) module, said LED module comprising:

a circuit board defining opposed circuit board first and second surfaces, said circuit board being provided with electrical conductors;

a power input electrically coupled to said electrical conductors;

a plurality of light emitting diodes (LEDs) provided on said circuit board first surface, each of said LEDs defining a respective light emitting surface, said light emitting surfaces facing substantially away from said circuit board, said LEDs being electrically coupled to said electrical conductors for being powered when said power input is powered;

an encapsulation layer covering said circuit board first surface and said LEDs, said encapsulation layer having an encapsulation layer index of refraction;

a correlated color temperature (CCT) correcting layer coating at least part of at least one of said light emitting surfaces and provided between said at least part of said at least one of said light emitting surfaces and said encapsulation layer, said CCT correcting layer having a CCT correcting layer index of refraction;

wherein said CCT correcting layer and encapsulation layer indices of refraction differ from each other, said encapsulation layer index of refraction being larger than said CCT correcting layer index of refraction.

2. The LED module as defined in claim 1, wherein said at least one of said light emitting surfaces is entirely coated with said CCT correcting layer.

3. The LED module as defined in claim 2, wherein said CCT correcting layer also covers at least part of said circuit board first surface.

4. The LED module as defined in claim 1, wherein said encapsulation layer is both waterproof and dustproof.

5. The LED module as defined in claim 1, wherein said encapsulation layer includes a silicone elastomer.

6. The LED module as defined in claim 1, wherein said encapsulation layer index of refraction is larger than said CCT correcting layer index of refraction.

7. The LED module as defined in claim 1, wherein said CCT correcting layer includes a gas.

8. The LED module as defined in claim 1, wherein said CCT correcting layer includes at least one of ethyl ortho silicate and titanium butoxide.

9. The LED module as defined claim 1, wherein said encapsulation layer surrounds substantially entirely said circuit board, LEDs, CCT correcting layer and electrical conductors; and and said power input protrudes from said encapsulation layer.

10. The LED module as defined in claim 1, wherein said LEDs each include a semiconductor covered by a respective primary LED encapsulation defining said light emitting surface, said primary LED encapsulation including a wavelength converting element for converting at least part of light emitted by said semiconductor to converted light having another wavelength, said encapsulating layer thereby providing a secondary encapsulation of said LEDs.

11. The LED module as defined in claim 1, further comprising a module body defining a recess delimited by a module rear wall and a module peripheral wall extending therefrom, said circuit board being mounted in said recess with said circuit board second surface facing said module rear wall in a spaced apart relationship relative thereto, wherein said encapsulation layer substantially fills said recess between said circuit board and said module rear wall.

12. The LED module as defined in claim 11, wherein said encapsulation layer has a thermal conductivity of about 0.1 W/m K or less.

13. The LED module as defined in claim 11, wherein said encapsulation layer is uncovered so as to be exposed to ambient air when said LED module is in use.

14. The LED module as defined in claim 11, wherein said encapsulation layer is vacuum sealed to said circuit board and module body.

15. The LED module as defined in claim 11, wherein said circuit board is provided with encapsulation apertures extending therethrough between said circuit board first and second surfaces, said encapsulation layer extending through said encapsulation apertures.

16. The LED module as defined in claim 11, wherein said CCT correcting layer is between 1 μm and about 100 μm thick.

17. A light emitting diode (LED) module, said LED module comprising:

a circuit board defining opposed circuit board first and second surfaces, said circuit board being provided with electrical conductors;

a power input electrically coupled to said electrical conductors;

a plurality of light emitting diodes (LEDs) provided on said circuit board first surface, each of said LEDs defining a respective light emitting surface, said light emitting surfaces facing substantially away from said circuit board, said LEDs being electrically coupled to said electrical conductors for being powered when said power input is powered;

an encapsulation layer covering said circuit board first surface and said LEDs, said encapsulation layer having an encapsulation layer index of refraction;

a correlated color temperature (CCT) correcting layer coating at least part of at least one of said light emitting surfaces and provided between said at least part of said at least one of said light emitting surfaces and said encapsulation layer, said CCT correcting layer having a CCT correcting layer index of refraction;

wherein said CCT correcting layer and encapsulation layer indices of refraction differ from each other, and wherein said CCT correcting layer includes gas bubbles.

18. The LED module as defined in claim 17, wherein said gas bubbles include $CO_2$ bubbles.

19. The LED module as defined in claim 17, wherein said gas bubbles include the gas of a substance that sublimes at room temperature.

20. The LED module as defined in claim 17, wherein said gas bubbles are dispersed in silicone.

21. The LED module as defined in claim 17, wherein at least 80% in volume of said gas bubbles are between 1 and 50 μm in size.

22. A method for manufacturing a light emitting diode (LED) module using a circuit board defining opposed circuit board first and second surfaces, said circuit board being provided with LEDs on said circuit board first surface, said LEDs each defining a light emitting surface facing away from said circuit board first surface, said LEDs being electrically connected to a power input, said method comprising the steps of:

(a) coating at least part of said circuit board and LEDs with a correlated color temperature (CCT) correcting material such that at least part of at least one of said light emitting surfaces is covered therewith to form a CCT correcting layer; and (b) covering said circuit board first surface, said LEDs and said CCT correcting material with an encapsulating material that differs from said CCT correcting material, said CCT correcting material and encapsulating material having different indices of refraction, said encapsulation layer index of refraction being larger than said CCT correcting layer index of refraction.

* * * * *